US005411258A

United States Patent [19]

Wilson et al.

[11] Patent Number: 5,411,258

[45] Date of Patent: May 2, 1995

[54] INTERACTIVE VIDEO HORSE-RACE GAME

[75] Inventors: Gordon Wilson; Danny Lowe; Michael Baker, all of Calgary, Canada

[73] Assignee: Fresh Logic Ltd., Alberta Calgary, Canada

[21] Appl. No.: 214,205

[22] Filed: Mar. 17, 1994

[51] Int. Cl.[6] ..... A63F 9/22

[52] U.S. Cl. ..... 273/86 B; 273/434; 273/85 G; 273/86 R; 364/410; 364/412

[58] Field of Search ..... 273/86 B, 85 G, DIG. 28, 273/434, 86 R; 364/410, 412

[56] References Cited

U.S. PATENT DOCUMENTS

| | | | |
|---|---|---|---|
| 4,373,723 | 2/1983 | Brown et al. | 273/86 B |
| 4,844,462 | 7/1989 | Lubniewski | 273/86 B |
| 5,186,460 | 2/1993 | Fongeallaz et al. | 273/86 B |
| 5,320,351 | 6/1994 | Suzuki | 273/86 B |
| 5,354,202 | 10/1994 | Monoriet et al. | 434/69 |

*Primary Examiner*—Vincent Millin
*Assistant Examiner*—Kerry H. Owens
*Attorney, Agent, or Firm*—Kent & Edgar

[57] ABSTRACT

An interactive video horse-race game comprising data storage and retrieval means; at least one pre-recorded video track of a horse-race stored in the data storage and retrieval means; at least one pre-recorded audio track of a horse-race stored in the data storage and retrieval means; wherein names of horses and their post and finishing positions in each of at least one audio track correspond to post and finishing positions of horses in corresponding ones of at least one video track; at least one race form stored in the data storage and retrieval means, one form corresponding to each audio track; means for preselecting one race form and a corresponding video and corresponding audio track to be replayed as a race being run; means for displaying the preselected race form; means for entering player identification into the data storage and retrieval means; means for selecting and entering player financial information into the data storage and retrieval means; means enabling players to enter bets on the outcome of the race displayed on each preselected race form into the data storage and retrieval means; means for replaying as a race being run, the preselected video and audio track; and means for tallying results of the bets against the financial information of the players.

54 Claims, 4 Drawing Sheets

INTERACTIVE VIDEO HORSE-RACE GAME

FIELD OF THE INVENTION

This invention relates to interactive video games.

1. BACKGROUND OF THE INVENTION

In recent years, accompanying the rapid development and widespread availability and use of microprocessors of various kinds, there has been fast growth in development of games which utilize microprocessors to perform various functions in playing the game. These games normally utilize video monitor displays to illustrate the games and input devices of various types enabling players to participate in the progress of the game. Such games in general are termed interactive video games.

Initially such games were very simple in format and were not intended to simulate real-life situations. However, the ongoing development of software and hardware has given rise to video games which in some cases are intended to simulate real-life situations.

To date many such games have continued to differ from real-life situations so that such games, while of interest, do not actually recreate the real-life situation.

The present invention is concerned with an interactive video game which simulates a satellite uplink television broadcast of a horse-race or a series of horse-races and which will put game players in respect of certain aspects of the game in precisely the same position as those players would be in had they attended a simulcast of an actual horse-race. The game of the present invention thus more closely simulates a real-life horse-race than have prior such games.

2. PRIOR ART

Applicant is not aware of any prior interactive video games which are similar to the present invention.

SUMMARY OF THE INVENTION

It is an object of the present invention to provide an interactive video horse-race game which will simulate a simulcast satellite uplink of an actual horse-race, particularly with respect to betting results, and at least to the extent of the finishing order of the win, place and show horses.

The present inventive game achieves a high degree of realism by recreating what appears to be an actual horse-race, by using methods as will be described in more detail below. As will be explained below, certain actual historical race form information will be available to a player, so that when a player places a bet in the course of the game, the player in placing the bet will have had the same information available as would have been available at the track when the actual race was run. The win, place and show positions will be the same in the game as in the historical race from which the race form was taken, so that the player's betting result will be exactly the same as it would have been had the player actually attended the race and placed a bet.

Thus, the invention provides an interactive video horse-race game comprising data storage and retrieval means, at least one pre-recorded video track of a horse-race stored in the data storage and retrieval means, at least one pre-recorded audio track of a horse-race stored in the data storage and retrieval means, wherein names of horses and their post and finishing positions in each at least one audio track correspond to post and finishing positions of horses in respective ones of the video track, at least one race form stored in the data storage and retrieval means, one form corresponding to each audio track, means for preselecting a race form from a race to be run and for selecting a corresponding video and corresponding audio track, means for displaying the preselected race form, means for entering player identification into the data storage and retrieval means, means for selecting and entering player financial information into the data storage and retrieval means, means enabling players to enter bets on the outcome of the race displayed on the preselected video track into the data storage and retrieval means, means for replaying as a race being run, the preselected video and audio track, and means for tallying results of the bets against the financial information of the players.

In a further embodiment there is provided an interactive video horse-race game comprising data storage and retrieval means, a microprocessor electronically associated with the data storage and retrieval means, a series of pre-recorded video tracks of horse-races, the video tracks stored in the data storage and retrieval means, a series of pre-recorded audio tracks of horse-races, the audio tracks stored in the data storage and retrieval means, wherein names of horses and their post and finishing positions in the audio tracks correspond to post and finishing positions in selected ones of the video tracks, a series of race forms stored in the data storage and retrieval means, one form corresponding to each audio track, means for preselecting one said race form for a race to be run and for selecting a corresponding video and a corresponding audio track, means for displaying the preselected race form, means for entering player identification into the data storage and retrieval means, means for selecting and entering player financial information into the data storage and retrieval means, means enabling players to enter bets on the outcome of the race displayed on the preselected video track into the data storage and retrieval means, means for replaying as a race being run, the preselected video and audio track, and means for tallying results of the bets against the financial information of the players.

In a further embodiment there is provided an interactive video horse-race game comprising data storage and retrieval means, a microprocessor and microprocessor control means electronically associated with the data storage and retrieval means, a series of pre-recorded video tracks of horse-races, the video tracks stored in the data storage and retrieval means, a series of pre-recorded audio tracks of horse-races, the audio tracks stored in the data storage and retrieval means, wherein names of horses and their post and finishing positions in the audio tracks correspond to post and finishing positions in selected ones of the video tracks, a series of race forms stored in the data storage and retrieval means, one form corresponding to each audio track; said microprocessor programmed to select a race form for a race to be run and to select a corresponding video and audio track, a computer display means for displaying the preselected race form, a keyboard or other input device for entering player identification into the data storage and retrieval means, the microprocessor programmed to select and enter player financial information into the data storage and retrieval means, the microprocessor programmed to enable players to enter bets on the outcome of the race displayed on the preselected video track, the microprocessor programmed to play on the computer display means the preselected video and audio track as a race being run, and the microprocessor programmed to tally results of the bets against the financial information of the players.

In a further embodiment there is provided an interactive video horse-race game comprising data storage and retrieval means, a microprocessor and microprocessor control means electronically associated with the data storage and retrieval means, a computer display means, an audio reproduction device and a keyboard or other input device electronically associated with the microprocessor, a series of video tracks of horse-races, the video tracks stored in the data storage and retrieval means, a series of audio tracks of horse-races, the audio tracks stored in the data storage and retrieval means, wherein names of horses and their post and finishing positions in the audio tracks correspond to post and finishing positions in selected ones of the video tracks, a series of race forms stored in the data storage and retrieval means, one form corresponding to each audio track, the microprocessor programmed for the following steps:

(i) to permit player identification information to be entered into the data storage and retrieval means, (ii) to select and store player financial data in a player game account in the data storage and retrieval means, (iii) to select and display on the display means one race form, and to select a corresponding audio and video track to be played as a race being run, (iv) to permit a player to record via the keyboard or other input device a bet on the outcome of the race, (v) to run the race on the display means and through the audio reproduction means, and (vi) to tally the results of the bet against the game account of the player.

GENERAL DESCRIPTION

The intention of the interactive video game of the invention is to recreate actual horse-race situations based on the use of actual historical race forms and the actual outcome of the races from which the forms are taken. Video and audio tracks may then be created for use in the game. The video tracks, audio tracks and race forms are all coordinated in respect of horse names, winning horse and winning post position. The manner in which this material will recreate an actual race situation is explained later.

The game thus comprises at least one racing form and preferably a series of such forms in storage and retrieval means. An audio track is provided to correspond in ways to be discussed to each of the forms. Also in storage are video tracks corresponding with each of the audio tracks and race forms, but note that several race forms and audios may be used for a single video, as will also be explained below.

Prior to the running of a race, the game player is presented with a daily racing form. The amount of information and layout of the racing form is determined by the level of play the game players are using. In novice mode, the daily racing form is presented in its most simplified form showing only the basic and most essential information needed by a game player to place a bet. The intermediate level contains more information and gives some information on each horse's past performance. The expert level of play displays a complete authentic racing form.

Each racing form presented is based on a real racing form used in the past at a real race track for an actual race. The form is disguised however by changing the dates on the form to correspond with the current date of the game, changing the names of the track locations, horse owners, breeders, trainers, jockeys and names of the horses. These name changes are made to correspond with the names used on the different audio tracks used with each video race.

Since the daily racing form used for each race is based on a real racing form used in the past, the actual results of that race when it was originally run have also been entered into the database. This information includes the order of finish and the payout figures for the winning horse.

Since the outcome of these races is based on the outcome of the original race there is no computer logic determining the outcome of a race. The basic information on each daily racing form is real and the outcome of that race is also real. The video race used with each racing form is selected to correspond to the same win, place and show finishing post positions as the original race. The "truth" of this method is that if the game player had attended the original race and made a betting decision based on the past performance information given in the original daily racing form, the results of the video race shown (with respect to the winning horse) would be identical and the player would win or lose the bet in the current game with the same results as if the player had attended and bet the original race.

The production design method used to display this game appears as close as possible to an actual "televised" race. Since commercial network television does not normally broadcast live horse racing, the production model used for this game is based on the typical satellite uplink broadcast used for off-track betting purposes. The game design is therefore produced to look and sound like a real off-track betting satellite uplink.

The game in one preferred format is packaged as a single CD-ROM disc game. Each CD-ROM disc contains 24 video races in three groups of 8 races per group. Each group of 8 races has 8 horses running in each race and each group of 8 races has each of the 8 horses (i.e. post positions) winning a race. In total there are 3 video races of each post position winning a race per disc. That embodiment would allow betting on the winning horse only.

In another preferred format the game is packaged as a set of two or more CD-ROM discs or in a compressed format on one or more discs. This format allows expansion of the game to 56 races allowing players to bet on each of win, place and show positions. All-combinations of win and place post positions for an eight-horse race would be available, and approximately 15% of win, place and show finishing combinations would be available.

In a further preferred format the game would comprise multiple CD-ROM discs containing a total of 336 races. Every combination of win, place and show finishing post positions would be available for each eight-horse race.

The video motion used for these races is in accordance with current CD-ROM video motion technology. Since the original footage is shot on broadcast quality video tape the video motion used is scaleable to upgrade to any current or new level of display technology. Since CD-ROM storage space limits the amount of full motion that can be stored on a disc, the display between races is preferably a combination of still video images and photorealistic graphical user interface screens.

Each video race is in turn accompanied by multiple audio tracks of a race track announcer mixed with sound effects. Each audio track uses a different combination of horses' names for that video race so that on each audio track a different "named" horse wins the race. In the single disc 8 race format, each named horse preferably runs in its group of 8 video races 4 times so that in each group of 8 video races there are a total of 16 "named" horses in each group. Since there are 3 groups of horses there are a total of 48 "named" horses included on each disc.

In the 56-race format the "generic" aspects of the audio tracks may be assembled with selected horse names to provide a large number of possible races from a single generic audio track. This will be explained in more detail later.

Each group of 8 horses is used as a different "claiming" class of horses. The values of these claiming classes may be $1,000, $2,500 and $5,000. An object of the game is to win enough money in the betting part of the program for a player to gain entry to the owners lounge and own and race a horse.

A "game account" is provided to each player into which a cash allowance is placed at opening. The account then fluctuates as the game proceeds as discussed below.

In one preferred embodiment there are three modes of game play offered to each player. The first mode of play is for multiple games (i.e. multiple "days" of racing) with the game player receiving a daily cash allowance with which to bet for each day of racing. The number of races shown on each day is determined by the game player, with a minimum of 4 races and a maximum of 10. The daily cash allowance may be fixed at $100 and the game will run until one player "owns" the track or all players have lost all money or until the game players re-install the game.

The second mode of play is also a multiple game scenario with a continuous series of daily racing programs. In this mode each player only receives an initial cash allowance (determined by the players, i.e. $5,000) and once that money is lost or spent, the game player is eliminated from the game (unless money is borrowed from another player).

The third mode of game play is for a single game only. In this version there will be an unlimited number of races shown until all players lose all their money, until one player owns the track or until the game players quit the program. These players will start with a specified amount of money determined by the players themselves in the initial setup screen and gamble with the money for the duration of play. The winner of this game will be the player with the most money or assets (i.e. horses owned).

The game is designed as a "User Friendly" game. There is a HELP screen function available to all players at all times. This help feature describes game functions or buttons so that a game player will be able to play the game without using a hard copy manual. The help feature also explains the terminology used in the game (i.e. daily double, etc.) and describes each column of information shown in the daily racing form (i.e. quarter times, weights carried, etc.). When a more complete or more extensive explanation may be useful for any help feature the game player is referred to a hard copy game manual preferably accompanying the game. This manual, along with these help features, completely explains all a player needs to know to go to a real race track and effectively "handicap" on the horses.

This tutorial function of the game is an important side benefit since it will stimulate interest in actual horse racing by teaching a player what is required to understand a racing form and so how to play the horses at a real track.

In beginning a game the screen tells the players the current setup for playing the game and asks them if they wish to change any of it. The setup information includes:

(1) Mode of play (multiple games, single game).
(2) Amount of cash.
(3) Number of races in the daily program.
(4) Number of minutes between races (5, 10, 15, 20 or manual control).

(1) MODE OF PLAY

This first setting will determine the type of game played by the game players. As noted above, there are three types of multiple game modes.

The first is Multiple 1 which is the default setting and is a continuous daily game in which the game players each get a $100 daily allowance each time they visit the track.

The second type is Multiple 2 which is also a continuous daily game but with a selected amount of cash to begin. When a player runs out of money the player is out of the game. The amount of money is selected as noted below.

The third type of game is the Single game. This game will run with an unlimited number of races until the players run out of money or quit.

(2) AMOUNT OF CASH

There are two options for selecting the opening amount of money for the modes of play.

First, if the player has selected the Multiple 1 game mode then each player will automatically receive a $100 daily allowance each time the player visits the track. This daily allowance will be added to cash on hand which will be accumulated from the previous days' races. This box therefore will not be changeable in Multiple 1 mode and remains fixed in amount.

Second, if the players have chosen Multiple 2 or Single game modes then this amount will show a default value of $1,000. The players will have the option of changing this amount by entering the amount through the keyboard. Once this amount is set, each player will have this amount entered into that player's game account as cash on hand. When cash on hand reaches zero the player will be eliminated from the game (unless arrangements are made to borrow money). In the case of a single player, the game will end.

(3) NUMBER OF RACES

The players have the option of setting the number of races run per daily race program. This option is only available for Multiple 1 and Multiple 2 modes. In Single game mode the races will continue until the players run out of money or quit.

(4) NUMBER OF MINUTES BETWEEN RACES

The players are able to select the amount of minutes between races. The default value will be 20 minutes, the maximum amount. The players will be able to speed up the pace of the game in 5 minute increments by selecting 15, 10 or 5 minute intervals between races. There is also a manual option which will allow the players unlimited time between races until they are ready to go to the track.

Additional information may be required to set the current date if the computer platform being used does not have a built-in clock/calendar.

All game players' names will be listed in a player list. Initially the players select names from a stored list which may be comical names such as Betting Bob, Hot Tip Harry, Pick Six Patty, etc. Players may be permitted to change the list by keyboard entry to enter, for example, real names. However, if this feature is used it will eliminate another feature of the program (described later) that will use the owner's name verbally in the post parade and winners circle.

Beside each player's name, financial information about that player will be included in a game account. This information will include:

(1) The number of races bet on to date.
(2) The number of wins selected.
(3) Total amount bet to date.
(4) Total amount of losses.
(5) Total amount of winnings.
(6) Total cash on hand.

Cash on hand is the total amount of monies a player has accumulated to the current date. Each day a player goes to the races, the player will be given an amount as discussed above with which to bet. A player may or may not use all of this money during the game. Any amount left over at the end of the day will be recorded in this column. This amount will also include any winnings for that day (less, of course, any money lost on bets that did not win). It should be noted that this amount will never be a negative figure since a player will not be allowed to bet on a horse if the player's game account does not have enough cash on hand to cover the bet. If a player's cash on hand reaches zero dollars then that player will not be able to play until the start of the next game, or until a loan is arranged from another player.

Player game account records are saved between games. When a new game is entered a file will also automatically be opened for this name and all subsequent information on that player saved. As a player wins, loses or spends money, this information is automatically saved and stored in the database.

The amount of cash on hand will be updated each time a player places a bet by deducting the amount bet, and each time the player bets on a winning horse, by adding the amount won. If that player is also an owner the claiming price for any horse bought will be deducted. As well, the entry fees will be deducted each time a horse is run and the purse added each time a horse wins.

This screen can be accessed at any time during the game from the main menu so that the players can refer to their current standings and cash on hand.

A late arriving player may be penalized by deducting an amount off the daily $100 that is proportional to the number of races left in the game. If, for example, a player arrives for the last race of six races, that player only receives $100/6 or $16 to add to cash on hand. There may also be deducted from this $16, gate admission and program costs of $15 so that the player will only receive $1 for the evening.

This will prevent players from accumulating money to buy a horse by simply saving daily cash allowances.

If a player does not bet during a game, the player will also be penalized with a deduction of $15 for gate admission and program costs. Also, if a player leaves the game early, the player will also be deducted gate admission and program costs.

If a player runs out of money during a game then one of three things will happen. First, in a Multiple 1 game mode, the player must exit the game or wait till the next day of racing to begin so that that player can get the next $100 daily cash allowance. In Multiple 2 game mode and Single game mode, once a player's cash on hand is zero, the game is lost. In all three game modes however, players can arrange a temporary loan of money so they can keep playing the current game. This loan will be negotiated with another player on the player list. This money must be paid back immediately at the end of the current day of racing. If a player is unable to pay back a loan (i.e. the borrowed money has been lost) the loan amount will be deducted from the next daily allowance. In Multiple 2 and Single game modes, if a player is unable to pay back the loan at the end of the current set of races, that player will be removed from the game as a "bad risk" unless another loan can be arranged.

A special loan feature from a "loan shark" may be included. If no other player is willing to loan the broke player money, then they must visit "Sharky" to arrange a "special" loan. This will not be a "friendly" loan, however. The player will be charged outrageous interest rates and failure to repay at a specified time will result in instantaneous and absolute removal from the game.

In order to place a normal bet a player simply selects a horse and indicates the amount desired to be bet (preferably in $2.00 increments). Assuming that the player has sufficient cash on hand in the game account, the bet will be recorded and the amount automatically deducted from cash on hand.

A countdown clock is provided to count down the minutes between races. Once the clock has counted down to zero, the betting windows are closed and no further bets may be placed.

There is also provision for placing exotic bets of various types. Typical such bets include daily double, pick 3, pick 4, etc., and variations with boxes or wheels, etc.

A tote board is provided which is non-interactive, displaying information only. The information displayed must be updated in real time as the betting pool and odds on each horse change. This information will be obtained through a totalisator program.

A totalisator program will be invisible to the user but is used to calculate odds and payouts on the horses.

The program uses standard algorithms to calculate the odds and payouts but includes some custom features specifically designed for this game.

For example, if only one person is playing the game, then if odds are calculated purely by the betting pool dollar figures, the player will never receive anything better than even money (less commissions) for a bet. Even if six or eight people are betting, this small betting pool will unfairly compromise the odds and payout figures. For this reason this program uses the racing form data to start off with the same opening odds that were used in the actual historic race.

Depending on the number of people playing the game the program will then, in the case of a single player, close with the actual odds recorded in the historical database or, in the case of multiple players, use the historical closing odds in conjunction with a weighted variant of the betting pool of the actual game players.

For example, if 6 people are playing, the program may weight each player as representing 100 or even 1000 people placing a bet and then factoring that betting pool into the actual historical betting pool so that each player's bet does have some effect on the final odds and payouts without totally biasing the program.

Optionally, each historical betting pool may be altered so that numbers of people betting on each race remain consistent (i.e. the total betting pool of a race from one track might be far less in numbers than a betting pool figure from another) and the betting pool shows a realistic curve of numbers peaking during the middle part of the program. The reason for this is that at a real race track, the first couple of races usually show less people betting than later on in the evening, since some people have not yet arrived. Similarly, a race track would start to lose some of the numbers of people as the evening ends, since some people would leave early or try to beat the rush of traffic.

In order to prepare to place the bets discussed, a player will have reference to the racing form. The daily racing form lists all pertinent information concerning the current race that a bettor needs to know. Since the game uses real racing forms there are some alterations in the original information on each racing form but these changes will only be for things such as horse, trainer and rider names, race track locations and dates. All other information on the original racing form that does not identify the origin or date of the form is to remain the same. Alterations in presentation may also be made to accommodate space restrictions, actual racing forms being around 160 columns wide.

All alterations to the racing form information must be made consistent with the remainder of the game. Thus, for example, if horse A is renamed as horse B, then throughout that program any re-occurrence of horse A's original name will also be changed to B. The same will apply to dates. For example, if a race is being run on Jun. 1, 1994 then all current dates on the form must read Jun. 1, 1994. Any dates showing on the original form that predate Jun. 1, 1994 must be chronologically correct. In other words, if the original race was run Sep. 1, 1990 and the past performance record shows a previous race run on Aug. 15, 1990, then the changed form that is running on Jun. 1, 1994 must show that same previous race as being run 15 days prior on May 15, 1994.

Also, if a player buys a horse then the racing form must also show the player's name listed as the owner until such time as the horse is claimed by another owner. This owner's name will be either one of the default player names chosen by the player or a name that has been entered via the keyboard.

Since a first preferred embodiment of the game will only have 24 races in 3 claiming classes, a claim horse will not be allowed to move to a different claiming class. Therefore the program must ensure that a $1,000 claim horse remains in a $1,000 claim race.

In the 56-race format of the game, which would allow a player to place win, place or show bets, a first version would have fixed audio tracks. That is to say, the names of the horses on each audio track would not be interchangeable. Again, therefore, this version would restrict horses to a specific claiming class.

A second version of the 56-race game utilizes a more sophisticated method of processing the audio which would allow manipulation of the horses names within each video race in an extremely large number of different combinations. To explain this method, a sample piece of dialogue from a typical video race may be used. For this explanation the names "Betlebub" for the horse starting in gate position number 1, "Hot Stuff" for the horse in gate number 2 and "Try Harder" for the horse in gate number 3 are used. In a full race there would be 8 horses and the race would run a full minute but for present purposes three horses will be used for just the opening dialogue of a typical race.

Track announcer:

"They're at the post . . . they're off . . . Betlebub is first out of the gate with Try Harder following closely behind . . . Hot Stuff is placing third and moving to the rail . . . Betlebub with Hot Stuff pulling in behind with Try Harder swinging out wide . . . ".

This announcer's dialogue is then broken down and processed as two different types of audio files called "Generic" and "Name" files. If each name file is replaced with a number designation that corresponds to the starting gate position of that horse, this dialogue example then becomes:

GENERIC FILE 001: "They're at the post . . . they're off . . .
NAME FILE 001: Betlebub
GENERIC FILE 002: is first out of the gate with
NAME FILE 003: Try Harder
GENERIC FILE 003: following closely behind . . .
NAME FILE 002: Hot Stuff
GENERIC FILE 004: is placing third and moving to the rail . . .
NAME FILE 001: Betlebub
GENERIC FILE 005: with
NAME FILE 002: Hot Stuff
GENERIC FILE 006: pulling in behind with
NAME FILE 003: Try Harder
GENERIC FILE 007: swinging out wide . . . "

There are several things to notice about this breakdown.

The Generic File consists of dialogue that is generic to the current video race and does not include any references to the names of any of the horses. These generic files are stored and listed in sequential order from 001 to nnn. Regardless of what horses names are used for the current race the Generic File for each video race remains unchanged and always in this sequential order.

The Name Files are different. The name file number designator refers to the starting gate position of the horse being described in the current video race so that the Name File is in essence a variable string file defined by the number attached to it. In this example since "Betlebub" is in starting gate position number 1 then throughout this race any time the race announcer refers to the horse running from that starting gate position, the file Name File 001 will contain the audio file that says the name "Betlebub". The same is true for each other horse in each other starting gate position.

It can be seen in this example that the Name File number designations are not sequential since they must refer to a particular horse that started in a unique gate position. Since there are to be 8 horses running each race it follows the Name File designators will be in the range from 001 to 008. This number will always be the same for each of the video races corresponding to the starting gate position of the horse currently being described. The actual name or audio file used for this variable however can be changed from race to race.

The name actually used will be determined by the name used in the daily race form assembled for that video race. The total number of horses names that can be used in this type of processing is limited only by the amount of storage space available.

An additional feature of this processing method is that each name stored in memory may be recorded with a number of different standardized voice inflections. For example, the name "Betlebub" could be stored with the emphasis on the first syllable, again with emphasis on the last syllable and again with equal emphasis on all syllables so that there would be three variations of the name "Betlebub". If these variations are stored as file names Betlebub.001, Betlebub.002 and Betlebub.003 then any one of these inflections can be called to be used for a particular name file in such manner that the voice inflection best suits the inflection of the race announcer narrative at the time the name is to be used.

In this example the type of voice inflection can then be designated in the Name File designator. For example voice inflection type 1 could be referred to by using the number 1 in the first or second number position of the Name File prefix so that Name File 001 would be referred to as either Name File 011, Name File 021 or Name File 031. The sample audio file for this race then becomes:

GENERIC FILE 001: "They're at the post . . . they're off . . .
NAME FILE 011: Betlebub
GENERIC FILE 002: is first out of the gate with
NAME FILE 023: Try Harder
GENERIC FILE 003: following closely behind . . .
NAME FILE 012: Hot Stuff
GENERIC FILE 004: is placing third and moving to the rail . . .
NAME FILE 011: Betlebub
GENERIC FILE 005: with
NAME FILE 022: Hot Stuff
GENERIC FILE 006: pulling in behind with
NAME FILE 023: Try Harder
GENERIC FILE 007: swinging out wide . . . "

The final format for storing an audio file for a race would not include the actual name of the horse to be used but instead would just use the Name File designator. Also since these files are likely to be stored in a different place on the CD-ROM disk than the corresponding video file the Generic File designator number may also include the video race number in the first two number positions of the file designator so that the complete audio file for a particular race consists of a listing of a number of smaller audio files that becomes:

VIDEO RACE NUMBER "XX"
GENERIC FILE XX1:
NAME FILE 011:
GENERIC FILE XX2:
NAME FILE 023:
GENERIC FILE XX3:
NAME FILE 012:
GENERIC FILE XX4:
NAME FILE 011:
GENERIC FILE XX5:
NAME FILE 022:
GENERIC FILE XX6:
NAME FILE 023:
GENERIC FILE XX7:

These audio files are then assembled in RAM memory before the start of the corresponding video race and then played back in sync with the corresponding video file. This file assembly will take place between races when the player is occupied referring to the daily racing form and deciding on which horse to bet. Since these audio files are stored in digital form the transfer of these files into memory may be accomplished very quickly and need not be done all at once since each file is assembled sequentially. A call routine may be used in the main application program that will call the next audio file to be assembled from memory and dump into RAM whenever the game player does not use the keyboard or input device for a specified time. If the player then makes an input during this file dump, the transfer can be aborted and tried again as soon as the player has finished the input. Since the transfer rate from CD-ROM is limited, the preferred method for storing these audio files is on hard disk allowing for a much faster access time and transfer rate as well as allowing the program to display files from CD-ROM while the audio files are being assembled in RAM.

Since the use of this type of audio would allow the interchange of horses' names in any of the video races, this version would allow horse owners to move the horses up or down between claiming classes.

The program will also preferably include a grade number for each horse on the original racing form on a scale of 1–10 (this grading will be made by a professional consultant). If, for example, in the $1,000 claiming class a horse bought by Owner A is graded as a 3 then when a $1,000 race is selected for the current game, the horse on the original form that is substituted for Owner A's horse must be a 3 horse. These gradings would be kept invisible so the owner would not know the grade of horse purchased. This allows the game to require the owner to have some skill in choosing a winning horse.

The forms selected for a day's races will initially be selected at random by the microprocessor. If, for example, six races are being run, then at the beginning of the game the computer will randomly select from the daily racing form database six races. These races will then be flagged to record how many times and when each racing form is used. This will help avoid using any one racing form too often and double check to make sure that the racing form chosen was not run recently. The amount of time to be allowed before a form can be used again will be determined by the size of the database. Obviously this would mean that as most forms get used for the first time, the remaining unused forms will be selected, making the program less and less random in its selection.

The daily racing form information will be provided to the totalisator program providing it with horses' names, post positions, opening and closing odds and the size of the betting pool.

The selected forms will then be used to select the appropriate video and audio tracks.

In order to buy a horse, a player will need an amount of money in the game account equal to or greater than the minimum claiming price plus the entry fee for the particular race.

When a player wishes to consider a purchase, that player can have all horses currently owned by game players displayed with a complete record of total earnings and losses to date. When a buyer wishes to purchase a horse, the horses running in the current race will be displayed and the buyer can then select any horse running and buy that horse for the claiming price. The player record is then updated and an amount equal to the claiming price is deducted from cash on hand. The buyer can only buy the horse before the race is run.

An owner can choose to either run or not to run the owner's horse in the day's races. This selection must be made at the beginning of the game.

Once a horse has been entered, the owner's cash on hand will be reduced by the amount of the entry fee for that race. Once a horse has been entered, no scratches are allowed.

Since disc space will be at a premium for the single disc game, the post parade will be a series of still frames only.

Since the post parade is an event used as part of the betting making decision and normally occurs before the betting windows close, then generic pictures of the horses must be used so that the outcome of the race is not forecasted by showing a recognizable picture.

The important part of this post parade is the text overlay which gives complete updated information on the betting and best times, etc.

The horses' names for the post parade will not be a problem for dialogue as long as the names of the horses are fixed in program development and not allowed to be changed. The owners' names, however, will not be possible to include at this time unless game players play under an alias fixed in memory. They would then have to choose this alias when they first start playing and start a game record. If each player does select such a fixed alias then this generic name can be used in several places during the game such as the post parade and the winners circle.

As indicated above, for the preferred single disc version of the game, there will be 24 video races stored on disc. Since there will be eight horses in each race three different video races can be stored for each post position coming in first.

Each video race will have eight separate audio tracks with it. These audio tracks will each use different names for the horses running in that race so that there will be eight different audio versions of each race. This will result in a total of 8 versions times 24 races or 192 different audio tracks that can be used.

As mentioned above, there will be a total of 24 video races stored on disc with three races for each post position coming in first. These races will therefore be divided into three separate groups (i.e. claiming classes) of 8 races each so that in each group each post position will come in first. Each race will also contain 8 different audio tracks so that each claiming class of 8 video races will have a total of 64 audio tracks. There are three possible ways that these different audio versions might be used.

First, each video/audio version may be used as a completely different race. In other words, the 8 audio tracks with each video version could use completely different names for the horses providing us with a total of 24 different groups of horses available to the program. This would provide a lot of variation in the audio but would mean that for any horse winning two races the player would see the same video race.

A second option would be to use only 8 groups of horses' names and thus have three versions of each race where any given horse comes in first. If these races are then flagged for use, the program could make sure that the same video race is not seen twice in a row. While this version limits the groups of different horse names, it does increase the variety in the video portion of the races.

A third and preferred hybrid version is to include each horse three or four times in its grouping. For example, in race 1 we would have horses A, B, C, D, E, F, G and H running. On the second audio track we could now include A, B, C and D but run the other post positions with I, J, K and L. Then in race 3 we could use E, F, G and H and from the second race I, J, K and L. A chart showing this progression is as follows:

EXAMPLE 1 (each horse running at least three times)

```
1ST AUDIO:  ABCDEFGH
2ND AUDIO:  A       G IJKLMN
3RD AUDIO:   B    F   I     NOPQR
4TH AUDIO:    C E     J   M O   RS  U
5TH AUDIO:     D    H  KL     PQ   TU
6TH AUDIO:    C E   H  K      PQ S  U
7TH AUDIO:   B    F    J   M O   R TU
8TH AUDIO:  A       G I  L N    RST
```

This type of progression would mean that every horse of a total of 21 different horses would race in three different races against 3 different groups of horses. This would allow creation of distinct groups which would facilitate the placing of horses in three different claiming classes with a total pool of 63 horses in the game. Each horse could then run three different races in its claiming class. Since there are also 8 different orders of finish for each audio track that would mean a pool of 24 different races that any one horse could run in.

EXAMPLE 2 (each horse running four times—preferred)

```
1ST AUDIO:  ABCDEFGH
2ND AUDIO:  A   D   G IJKLM
3RD AUDIO:   B    F HI    MNOP
4TH AUDIO:  A C E     J L NOP
5TH AUDIO:      DEF H KLM   P
6TH AUDIO:   BC E     I KL NO
7TH AUDIO:   B D FG   J   MN P
8TH AUDIO:  A C     GHIJK     O
```

This arrangement would mean that every horse would run in four different races in its claiming class. There would be a total of 16 different horses in each claiming class for a total of 48 different horses in the game.

Although these examples show each horse remaining in the same post position for each audio track, the horses would in fact be moved around, so Horse A might run in first post position on audio track 1, but then run in a different post position on audio track 2.

It should be noted here that great care must be taken in selecting the post positions to correspond to the correct position on the racing form and on the audio/video track.

A WINNERS CIRCLE will preferably be shown at the end of the video race. It will be a still image to conserve storage space on the disc.

A text overlay over this image displays the winning horse's name, the jockey's name, the owner's name and other information usually supplied at this stage of an actual race. There may optimally be a generic narration segment that goes with this video still similar to that described for the post parade.

A clock timer in the system is responsible for setting the timing for different parts of the program. It is also responsible for setting the date of the current game if the computer being used has its own clock/date system installed. If so, then the clock timer would be responsible for talking to this device and setting the correct date for the initial setup screen. If no date/clock is present, then the game player may be prompted to enter the current date during the initial setup screen.

During normal play of the game, the clock timer's primary function is to control the time between races as selected initially. The clock timer will then display the amount of time remaining till the next race and when it is time to start the next race it will automatically trigger the closing of the betting windows and the start of the race.

If the game players have selected the manual mode of operation for the "time between races" then the countdown clock timer will not be functional and show no display.

When all races for the current game have been run, the program will automatically take the players out of the game. Providing the players have stayed for the whole game and have placed a minimum amount of their daily $100 cash allowance, then they will exit without paying any cash penalty.

There are several ways that a player may incur a cash penalty at the end of the game.

The cash penalties will be given in the form of parking fees, entrance fees and program fees and are designed to force game players into betting their daily cash allowance and to prevent any game player from building up cash on hand by attending the races and not betting. This will also mean that in order for a player to obtain enough cash on hand to gain entrance to the owners lounge, that player must bet on the horses and gain a certain amount of skill in playing the horses.

A player who attends the whole game and bets at least $90 of daily cash allowance will be given free parking, admission and program. Any remaining monies (a maximum of $10 plus daily winnings) will be added to cash on hand and made available the next time the player plays a game.

A player who attends the whole game and bets less than $90 but more than $75 will be given free admission and free program but charged $10 for parking. Any remaining monies (a maximum of $15 plus daily winnings) will be added to cash on hand and made available the next time the player plays a game.

A player who attends the whole game and bets less than $75 but more than $60 will receive a free program but be charged $10 admission and $10 parking. Any remaining monies (a maximum of $20 plus daily winnings) will be added to cash on hand and made available the next time the player plays a game.

A player who attends the whole game and bets less than $60 but more than $50 will be charged $25 for parking, admission and program. Any remaining monies (a maximum of $25 plus daily winnings) will be added to cash on hand and made available the next time the player plays a game.

A player who attends the whole game and bets less than $50 but more than $25 will be deducted a $25 penalty and charged an additional $25 for parking, admission and program. Any remaining monies (a maximum of $25 plus daily winnings) will be added to cash on hand and made available the next time the player plays a game.

A player who attends the whole game and bets less than $25 will be deducted a $50 penalty and charged an additional $25 for parking, admission and program. Any remaining monies (a maximum of $23 plus daily winnings) will be added to cash on hand and made available the next time the player plays a game.

If a player does not place any bets during the game, that player will forfeit the daily cash allowance of $100 and be deducted an additional $10 parking fee, $10 entrance fee and $5 program fee from any remaining cash on hand.

If a player quits a game and "goes home early", that player will incur a cash penalty that will vary in accordance with how early the player quits the game, whether there is any cash on hand and how much was bet prior to leaving.

First, if a player quits because that player has lost all cash on hand, then there will be no additional penalties.

Also, if a player loses $100 in any one game (an amount equal to the daily cash allowance) but still retains cash on hand, there will not be any penalty for leaving the track early.

Penalties will occur if a player who has not bet a $90 minimum and still has cash on hand leaves early.

The penalty levied is a combination of end game penalties that will vary with the amount bet plus the amount deducted from a player who arrives late in the game so that the amount received for daily allowance is reduced by an amount equal to the percentage of races missed by leaving early.

For example, if a player goes home after the 4th race after betting only $45, then the player will be penalized an amount of $25 for betting less than $50 plus a $25 charge for parking, admission and program plus 2/6 times $100 or $32 dollars for missing the last two races. In this case the player had bet $45, been charged $50 and had $32 taken from daily allowance so that if the player did not win a single bet the player would have lost $27 from any remaining cash on hand.

This may seem onerous but it should be noted that the player has not bet in large amounts and has left the game early. Since this is a game, we must encourage the player to participate and while the penalties for just going home or just not betting enough money reduce the amount of cash on hand that is accumulated for the next game, to both go home early and not bet a large amount of money can penalize the player by reducing any accumulation of cash on hand.

A useful feature of this game is the HELP screen.

The help screen will be made available to the game player throughout the entire game.

The help screen will allow a player to get a text overlay window on the screen explaining the function of the item or feature selected by the player.

This will be especially useful in the daily racing form graphics and at the betting windows. The daily racing form consists (in the expert play level) of up to 160 columns of information data. This data includes complete past performance statistics on each horse running in the current race. This information is listed in data columns and unless the player is familiar with the layout of the racing form, the meaning of these data columns can be quite obscure. Even when explained at the top of a column, the meaning of the data is not always obvious. For example, a "pp" will indicate the post position of a horse. This might seem simple but the player must know what a post position is and whether the data refers to the starting post position of the horse or whether it refers to the finishing post position of the winning horse.

The same is true for other information such as quarter times, etc.

There are preferably two or three levels of complexity to the readout or print of the daily racing form. These levels will be novice or expert levels with optionally an intermediate level. The novice level includes a simplified version of the daily racing form so that it is easier to read. An intermediate level would contain more information on the form. The expert level will show a complete version of the daily racing form.

In a preferred embodiment, individual players may select the level. In the same game some players may be using expert level and others novice level.

It should be noted that the help function is available to all players at all levels at any time in the game to assist in understanding the racing form.

Similarly, in the betting windows, the player may not understand the function or purpose of a particular button, for example, a button might indicate a type of bet such as a daily double or pick three. If the player clicks on the help button, an explanation of what a daily double or pick three bet is and how it is placed will be provided.

BRIEF DESCRIPTION OF THE DRAWINGS

These and other objects and advantages of the invention will become apparent upon reading the following detailed description and upon referring to the drawings in which.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
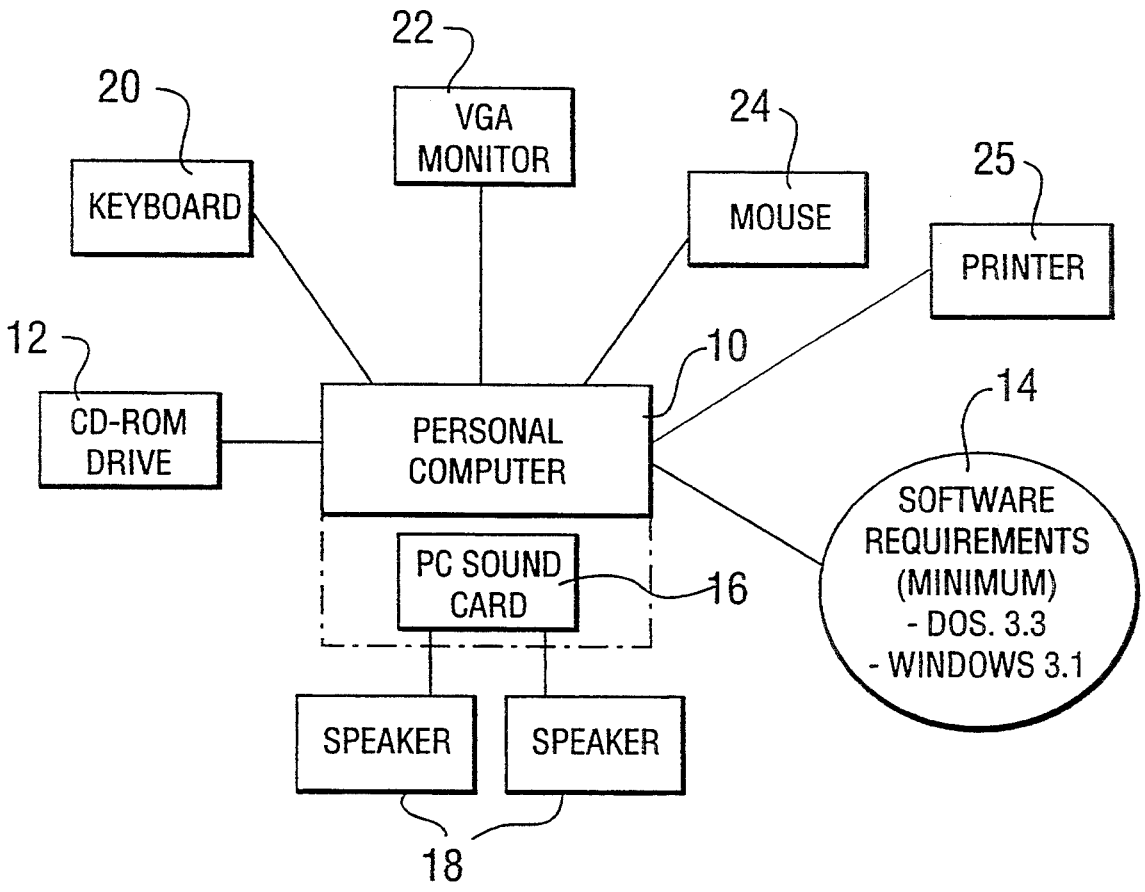
FIG. 1 is a schematic of user hardware configuration and requirements to play the game of the invention.

While the game of the invention lends itself to use in casinos and other gambling establishments, it will be described in terms of a preferred configuration for use with personal computers for the home video game market. For this use FIG. 1 illustrates a typical end-user hardware configuration.

As a minimum PC 10 will be a 386, although the recommended PC 10 will be a 486 33 Mhz or better machine with a minimum of 4 Meg of free RAM and a minimum of 12 Mb free on hard drive. A 2× speed CD-ROM drive 12 is recommended. The minimum requirements for software 14 are for DOS 3.3 and WINDOWS 3.1, but with DOS 5.1 preferred.

A sound card 16 is required along with a speaker or speakers 18.

A keyboard 20 and VGA monitor 22 are also required. A mouse 24 and a printer 25 are optional but recommended to optimize enjoyment.

Figure 2:
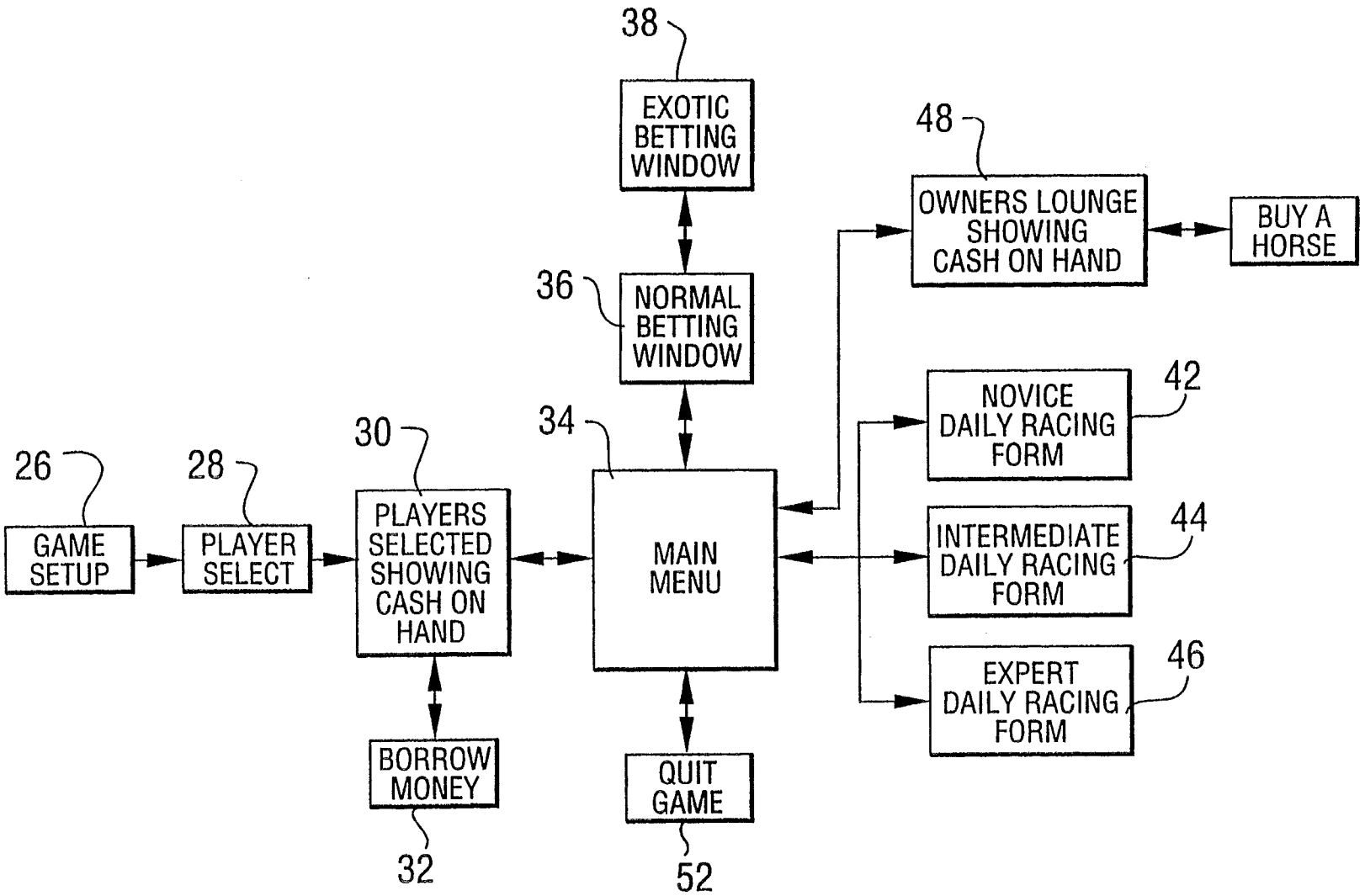
FIG. 2 is a block diagram showing interactive screens used in playing the game.

FIG. 2 illustrates the game sequence flow charts in terms of the interactive graphical user interface screens only. The game setup screen 26 allows players to make selections through keyboard 20 as to:

(1) mode of play, (2) amount of money to be credited to a cash-on-hand segment of a game account of each player, (3) number of races to be run in a race program, as, for example, a daily program, and (4) number of minutes between races.

These setup items have been described at some length in the general description.

The PLAYER SELECT screen 28 enables game players to enter names on a player list. As discussed earlier, names may be chosen from a fixed list of fictitious names or, optionally, may be chosen and entered as, for example, the players' real names. There are advantages to using the fixed name format, since those fixed names can then be used audibly in other parts of the game such as the POST PARADE and the WINNERS CIRCLE. The player list will include in a game financial information about each player. Information included in the listing will be the number of races on which bets have been placed, the number of wins, the amount bet, amount of losses, amount of winnings, and, most importantly, cash on hand. The cash-on-hand entry will vary throughout the game as transactions occur which increase or decrease a player's available cash.

The player list 30 contains similar information to that which first appeared in the PLAYER SELECT screen. This screen, as discussed earlier, will permit players to negotiate loans where their cash on hand has been exhausted. This is done through interaction with the BORROW MONEY screen 32 by negotiation with other players.

Figure 3:
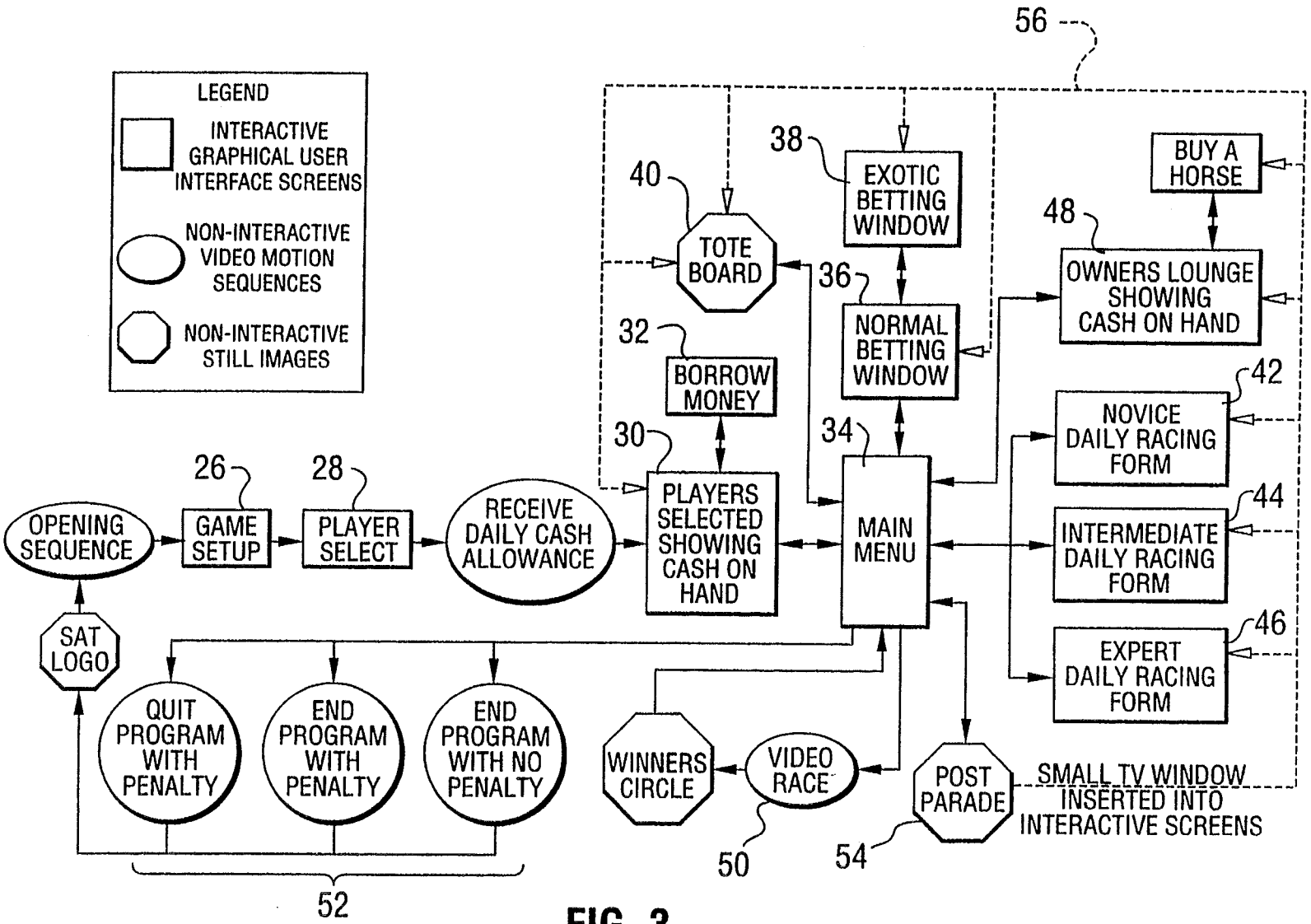
FIG. 3 is a block diagram comprising a game sequence flow chart for the game of the invention.

The MAIN MENU screen 34 is the centre through which various other parts of the game are accessed. From the main menu players can access the player list 30, previously described; BETTING WINDOW 36 and hence EXOTIC BETTING WINDOW 38; TOTE BOARD 40 (FIG. 3); DAILY RACING FORMS 42, 44 and 46; OWNERS LOUNGE 48; TRACK 50 (FIG. 3); and QUIT GAME 52.

There are certain restrictions and controls on access. Thus, while any player may access the player list, the betting windows, the tote board and the daily racing form, the owners lounge may only be accessed by horse owners or players who have sufficient cash on hand to purchase a horse and pay a race entry fee.

The main menu screen will include the countdown clock, giving the time remaining to the next race. Once the clock has counted down to zero, players will automatically be taken to TRACK 50 (FIG. 3).

The normal BETTING WINDOW 36 is accessed from the MAIN MENU 34. In placing a bet through the normal betting screen the player name must be identified. The bet may then be entered only if the player's cash on hand is sufficient to cover the bet. The screen will display the current cash on hand for the selected player. As discussed earlier, the screen provides for identification of the race, horse and amount of bet.

The betting window is closed automatically when the countdown clock reaches zero, thus indicating the beginning of a race.

A separate screen 38 is provided for the placing of exotic bets. This operates essentially in the same way as the normal betting window with the exception that daily double, multiple picks and similar types of bets may be placed. This implies that the race forms are required for the day's races, so that these selections can be made.

The effect of bets placed on the odds in a race is recorded on the TOTE BOARD 40 which is a non-interactive screen. The totalisator program described earlier will establish the odds, taking into account the actual historic odds and a weighted effect of bets placed by the players.

The DAILY RACING FORMS 42, 44 and 46 are also accessed through the main menu. These forms lie at the heart of the game, since they provide the information from which game players can assess the horses in a given race preparatory to placing bets.

The OWNERS LOUNGE screen 48 enables players having sufficient cash on hand to purchase horses in a claim race. Access to this screen is limited to players who have sufficient cash on hand to make such a purchase and, in addition, to pay a race entry fee once a horse has been purchased.

A player exits the game through the various end programs which were discussed at length earlier. These aspects of the game are also accessed through the main menu.

FIG. 3 is a flow chart illustrating the game sequence. Of note, the POST PARADE screen 54 is preferably available at various of the interactive screens to enable players to finalize decisions such as betting, and claiming. This is illustrated by a window insert flow path 56 to various of the interactive screens.

Figure 4:
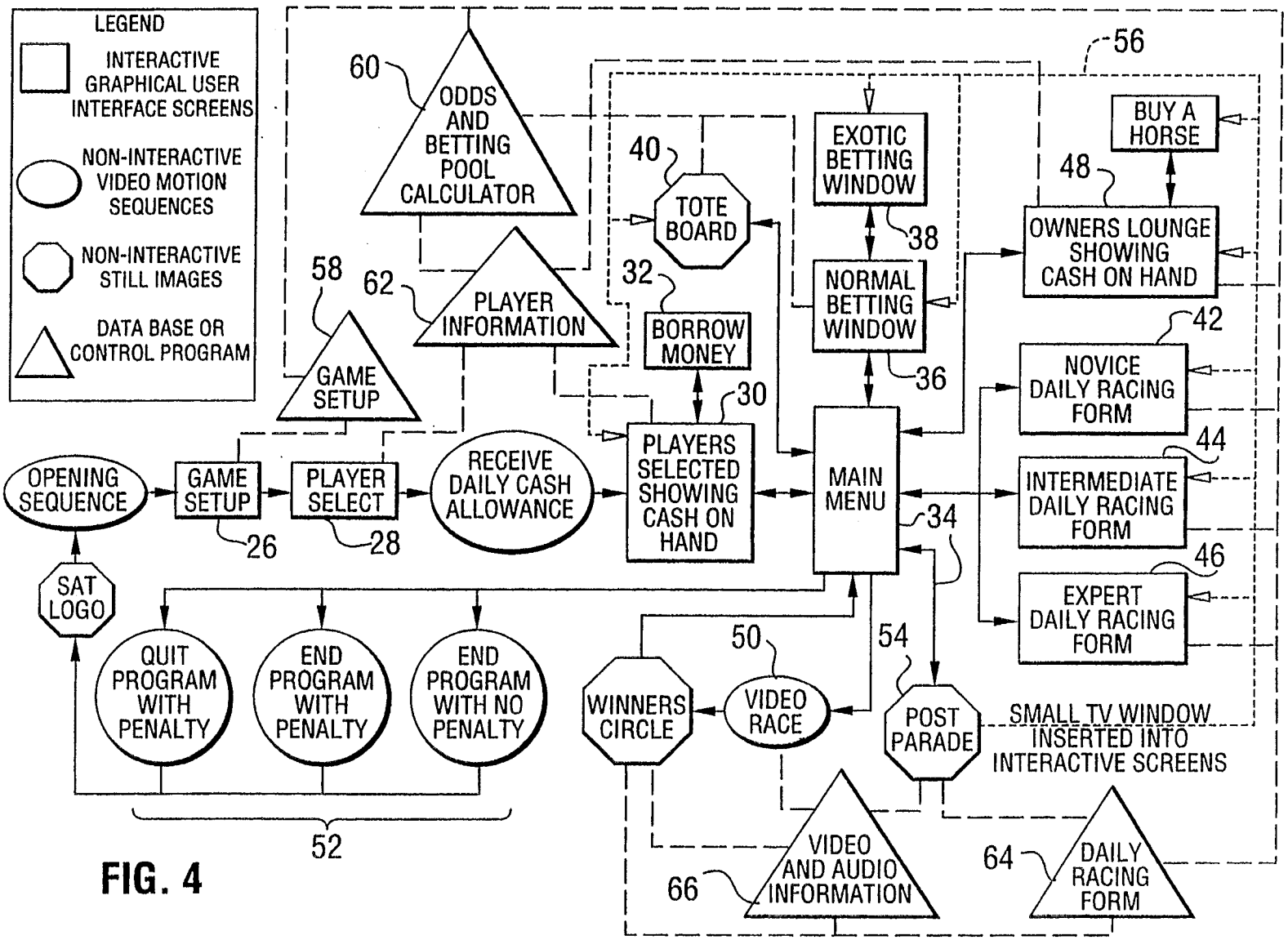
FIG. 4 is a block diagram of the game of the invention.

FIG. 4 is a block diagram for the game. This figure illustrates the interconnections of the various databases and control programs which are utilized in the game.

As earlier discussed, various initial selections are presented to the players to set up and control the game through the GAME SETUP screen 26 and, as illustrated in FIG. 4, through the SETUP program 58.

The totalisator program is illustrated at 60.

Also illustrated in FIG. 4 are the player information database 62, the daily racing form database 64 and the video and audio track information database 66.

Thus, expressed in simplest terms the players set up the game and introduce player identification information. The players receive cash allowances. The players then review the daily racing form and based on that review enter bets on the outcome of the race. Optionally and depending on the amount of cash on hand that a player may have, a player may purchase one or more horses. The race is then run and results posted to the players individual game accounts.

If all players participate in the full program, the game continues until the day's races have been completed at which time the game is terminated. Player accounts are stored and recalled at the commencement of the next day's racing program.

Thus it is apparent that there has been provided in accordance with the invention an interactive video horse-race game that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. An interactive video horse-race game comprising:
data storage and retrieval means;
at least one pre-recorded video track of a horse-race, said at least one video track stored in said data storage and retrieval means;
at least one pre-recorded audio track of a horse-race, said at least one audio track stored in said data storage and retrieval means;
wherein names of horses and their post and finishing positions in each said at least one audio track correspond to post and finishing positions of horses in corresponding ones of said at least one video track;
at least one race form stored in said data storage and retrieval means, one said form corresponding to each said audio track;
means for preselecting one said race form and a corresponding video and corresponding audio track to be replayed as a race being run;
means for displaying said preselected race form;
means for entering player identification into said data storage and retrieval means;
means for selecting and entering player financial information into said data storage and retrieval means;
means enabling players to enter bets on the outcome of the race displayed on each said preselected race form into said data storage and retrieval means;
means for replaying as a race being run, said preselected video and audio track; and
means for tallying results of said bets against said financial information of said players.

2. The game of claim 1 wherein each said at least one audio track is initially a generic audio track having no horse names thereon; and said game further comprising:
a series of racehorse names stored in said data storage and retrieval means; and
means for selecting horse names from said data storage and retrieval means and assembling said horse names so selected into a selected said audio track, said audio track then corresponding to one said video track.

3. The game of claim 2 wherein said horse names to be selected for each said audio track are specified by said race form corresponding to each said audio track.

4. An interactive video horse-race game comprising:
data storage and retrieval means;
a microprocessor electronically associated with said data storage and retrieval means;
a series of pre-recorded video tracks of horse-races, said video tracks stored in said data storage and retrieval means;
a series of pre-recorded audio tracks of horse-races, said audio tracks stored in said data storage and retrieval means;
wherein names of horses and their post and finishing positions in said audio tracks correspond to post and finishing positions in corresponding ones of said video tracks;
a series of race forms stored in said data storage and retrieval means, one said form corresponding to each said audio track;
means for preselecting at least one said race form and a corresponding video and a corresponding audio track to be replayed as a race being run;
means for displaying each said preselected race form;
means for entering player identification into said data storage and retrieval means;
means for selecting and entering player financial information into said data storage and retrieval means;

means enabling players to enter bets on the outcome of the race displayed on each said preselected race form into said data storage and retrieval means;

means for playing as a race being run, said preselected video and audio track; and means for tallying results of said bets against said financial information of said players.

5. The game of claim 4 wherein said means for preselecting an audio and video track and said corresponding race form comprises said microprocessor wherein said microprocessor is programmed to make said selection.

6. The game of claim 4 wherein said means for displaying said preselected race form comprises a VGA monitor.

7. The game of claim 6 wherein said monitor includes sound reproduction means.

8. The game of claim 7 wherein said sound reproduction means comprises a sound card and at least one speaker,

9. The race of claim 4 wherein said means for displaying said preselected race form comprises a printer electronically associated with said microprocessor,

10. The race of claim 6 wherein said means for displaying further comprises a printer electronically associated with said microprocessor.

11. The game of claim 4 wherein said means for entering comprises a keyboard electronically associated with said microprocessor.

12. The game of claim 11 wherein said player identification comprises a name.

13. The game of claim 4 wherein each said player is allocated a game account by said microprocessor and wherein said financial information comprises at least a dollar figure representing cash on hand in said player's game account.

14. The game of claim 4 wherein said means enabling comprises a keyboard electronically associated with said microprocessor.

15. The game of claim 4 wherein said means for replaying comprises a VGA terminal.

16. The game of claim 4 wherein said means for tallying comprises said microprocessor.

17. The game of claim 4 wherein each said at least one audio track is initially a generic audio track having no horse names thereon; and said game further comprising:

a series of racehorse names stored in said data storage and retrieval means; and means for selecting horse names from said data storage and retrieval means and assembling said horse names so selected into a selected said audio track, said audio track then corresponding to one said video track.

18. The game of claim 17 wherein said horse names to be selected for each said audio track are specified by said race form corresponding to each said audio track.

19. An interactive video horse-race game comprising:

data storage and retrieval means;

a microprocessor and microprocessor control means electronically associated with said data storage and retrieval means;

a series of pre-recorded video tracks of horse-races, said video tracks stored in said data storage and retrieval means;

a series of pre-recorded audio tracks of horse-races, said audio tracks stored in said data storage and retrieval means;

wherein names of horses and their post and finishing positions in said audio tracks correspond to post and finishing positions in corresponding ones of said video tracks;

a series of race forms stored in said data storage and retrieval means, one said form corresponding to each said audio track;

said microprocessor programmed to select at least one said race form and a corresponding video and audio track to be replayed as a race being run;

a video monitor for displaying said preselected race form;

a keyboard for entering player identification into said data storage and retrieval means;

said microprocessor programmed to select and enter player financial information into said data storage and retrieval means;

said microprocessor programmed to enable players to enter bets on the outcome of the race displayed on said preselected race form;

said microprocessor programmed to replay on said video monitor said preselected video and audio track as a race being run; and said microprocessor programmed to tally results of said bets against said financial information of said players.

20. The game of claim 3 wherein each said at least one audio track is initially a generic audio track having no horse names thereon; and said game further comprising:

a series of racehorse names stored in said data storage and retrieval means; and means for selecting horse names from said data storage and retrieval means, and assembling said horse names so selected into a selected said audio track, said audio track then corresponding to one said video track.

21. The game of claim 20 wherein said horse names to be selected for each said audio track are specified by said race form corresponding to each said audio track.

22. An interactive video horse-race game comprising:

data storage and retrieval means;

a microprocessor and microprocessor control means electronically associated with said data storage and retrieval means;

a computer display device, an audio reproduction device and an input device electronically associated with said microprocessor;

a series of video tracks of horse-races, said video tracks stored in said data storage and retrieval means;

a series of audio tracks of horse-races, said audio tracks stored in said data storage and retrieval means;

wherein names of horses and their post and finishing positions in said audio tracks correspond to post and finishing positions in corresponding ones of said video tracks;

a series of race forms stored in said data storage and retrieval means, one said form corresponding to each said audio track;

said microprocessor programmed for the following steps:

(i) to permit player identification information to be entered into said data storage and retrieval means, (ii) to select and store player financial data including a cash on hand amount in a player game account in said data storage and retrieval means, (iii) to select and display on said display device one said race form, and to select a corresponding said audio and said video track to be played as a race being run, (iv) to permit a player to record via said input device a bet on the outcome of said race, (v) to run said race on said display device and through said audio reproduction means, and (vi) to tally the results of said bet against said game account of said player.

23. The game of claim 22 wherein said microprocessor is programmed to select, based on player inputs from said input device, a predetermined number of race forms and corresponding audio and video tracks to be run as a race day comprising a segment of said game.

24. The game of claim 22 wherein said microprocessor is programmed to select and run based on predetermined player inputs a series of said race days to comprise a game.

25. The game of claim 22 wherein said race forms are recreations of actual historical race forms.

26. The game of claim 25 wherein identification indicia has been changed on said race forms so that a game player could not readily identify the actual race represented by the form.

27. The game of claim 26 wherein said changed information is chosen from the race date and place; trainer, breeder and rider names, and horse names.

28. The game of claim 27 wherein the horse names on each said audio track correspond to those on respective ones of said changed race forms.

29. The game of claim 28 wherein each said audio and each said video track provide the same winning post position as the winning post position in the actual race from which a respective one of said race forms is derived.

30. The game of claim 22 wherein said financial data for any given player initially comprises an opening amount designated as cash on hand and which amount is generated by said microprocessor responsive to selected input data input via said keyboard.

31. The game of claim 30 wherein said input data comprises entry of said opening amount directly from said keyboard.

32. The game of claim 30 wherein said input date comprises a preselected one from a group of game modes responsive to which said microprocessor selects said opening amount.

33. The game of claim 32 wherein said input data comprises a game mode input indicating to said microprocessor that said opening amount in respect of a particular player is to comprise a closing amount of said player from a next preceding race, said closing amount having been stored in said data storage and retrieval means.

34. The game of claim 26 wherein said financial data subsequently stored in a player game account is selected from the group comprising:

(i) number of races upon which the player has bet to date;

(ii) number of wins to date;

(iii) amount bet to date;

(iv) amount of losses to date;

(v) amount of winnings to date;

(vi) cash on hand.

35. The game of claim 23 wherein said microprocessor is programmed to make an initial said race form selection on a random basis from available said race forms.

36. The game of claim 35 wherein said microprocessor is programmed to exclude in subsequent said race form selections at least some previously selected race forms.

37. The game of claim 36 wherein said microprocessor is further programmed to select and display betting odds on said race based on preselected criteria.

38. The game of claim 37 wherein said odds are initially established as opening odds comprising the actual opening odds of said actual race from which said race form is derived.

39. The game of claim 38 wherein said microprocessor is programmed to change said odds as bets are placed, the changed odds calculated from actual closing odds of said race and a weighted variant of the betting pool of the actual game players.

40. The game of claim 23 wherein said microprocessor is programmed to permit players to place only win bets on said race.

41. The game of claim 22 wherein said microprocessor is programmed to select and display a series of race forms to comprise a set of races for a race day and to permit conventional multi-race bets to be placed.

42. The game of claim 22 wherein said microprocessor is further programmed to permit said bet to be placed only when the amount recorded as cash on hand in a player game account equals or exceeds the amount of that bet.

43. The game of claim 23 wherein said microprocessor is further programmed to permit a player to record a bet only during a predetermined countdown period.

44. The game of claim 43 wherein said microprocessor is programmed to return to step (iii) and to then select and display a second race form and to then repeat subsequent steps, and wherein said countdown period is the time between the running of two selected races on said display device.

45. The game of claim 22 wherein said microprocessor is further programmed to permit a player through predetermined inputs through said input device to purchase a horse in a race at a predetermined claiming price.

46. The game of claim 45 wherein said microprocessor is programmed to deduct from a player's game account an amount committed by that player to purchase a horse.

47. The game of claim 45 wherein said microprocessor is further programmed to credit to a player's game account amounts determined as purses for races won by a horse purchased by that player.

48. The game of claim 45 wherein said microprocessor is further programmed to permit a player who has purchased a horse to elect through said input device not to have that horse run in a given race or races.

49. The game of claim 45 wherein said microprocessor is further programmed to permit a player through predetermined inputs to move a horse owned by that player from one to another claiming class.

50. The game of claim 45 wherein said microprocessor is further programmed to deduct from a player's game account an amount in respect of an entry fee where a horse purchased by that player appears in a race.

51. The game of claim 45 wherein said microprocessor is further programmed to end the game responsive to the occurrence of a predetermined event chosen from:

(a) a predetermined number of races having been run;

(b) a single player having purchased all horses;

(c) all players' game accounts having been reduced to zero, or (d) the players choosing to end the game by entry of an input device command.

52. The game of claim 50 wherein said microprocessor is programmed to penalize a player by deducting predetermined amounts from said player's game account at the end of a game, said penalties based on a failure of said player to meet a predetermined financial participation requirement in said game.

53. The game of claim 52 wherein said financial participation requirement comprises a minimum amount bet on the races in a game.

54. The game of claim 22 wherein each said at least one audio track is initially a generic audio track having no horse names thereon; and said game further comprising:

a series of racehorse names stored in said data storage and retrieval means;

said microprocessor programmed for the following additional steps after said selecting of one said race form: (iii) (a) to select from among said racehorse names, names specified in said selected race form and to assemble said horse names so selected into said corresponding audio track.

* * * * *